US009834903B2

(12) United States Patent
Armstrong et al.

(10) Patent No.: US 9,834,903 B2
(45) Date of Patent: Dec. 5, 2017

(54) UNDERGROUND SECURITY BARRIER

(71) Applicants: Jon W. Armstrong, Corona, CA (US); Daniel P. Zapalac, Corona, CA (US)

(72) Inventors: Jon W. Armstrong, Corona, CA (US); Daniel P. Zapalac, Corona, CA (US)

( * ) Notice: Subject to any disclaimer, the term of this patent is extended or adjusted under 35 U.S.C. 154(b) by 142 days.

(21) Appl. No.: 14/965,898

(22) Filed: Dec. 11, 2015

(65) Prior Publication Data

US 2017/0167107 A1 Jun. 15, 2017

(51) Int. Cl.

| | |
|---|---|
| ***E02D 29/14*** | (2006.01) |
| ***E05C 19/00*** | (2006.01) |
| ***E05B 67/00*** | (2006.01) |
| ***E05B 65/00*** | (2006.01) |

(52) U.S. Cl.

CPC ..... *E02D 29/1481* (2013.01); *E02D 29/1427* (2013.01); *E05B 65/006* (2013.01); *E05B 67/00* (2013.01); *E05C 19/003* (2013.01); *E05C 19/007* (2013.01); *E05C 19/009* (2013.01)

(58) Field of Classification Search

CPC ..... E02D 29/1427; E02D 29/1481; E05B 65/006; E05C 19/003; E05C 19/009

USPC ..... 404/25

See application file for complete search history.

(56) References Cited

U.S. PATENT DOCUMENTS

| | | | | |
|---|---|---|---|---|
| 1,065,358 | A * | 6/1913 | Hanson | E05B 65/006 70/168 |
| 1,876,237 | A * | 9/1932 | Jackson | E05B 65/006 292/212 |
| 5,328,294 | A * | 7/1994 | Miller | E02D 29/1445 249/145 |
| 7,704,010 | B2 * | 4/2010 | Nolle | E02D 29/14 404/25 |
| 9,587,368 | B2 * | 3/2017 | Smith | E02D 29/128 |

* cited by examiner

*Primary Examiner* — Gary S Hartmann

(74) *Attorney, Agent, or Firm* — Frederic M. Douglas

(57) ABSTRACT

The present invention relates to a secure barrier for an underground valve box. The device may have a bolt and a nut for adjusting the length of the bolt to position curved plates to press against the inner circumference of a cylindrical valve box. The bolt housing may include a flange that protrudes through a slot in a horizontal metal plate. The plate may have handles for ease of lifting and replacement of the plate. The protruding flange may feature a hole for insertion of a padlock. When the padlock is secured, the plate cannot be removed from the cylindrical valve box as the adjustable bolt housing cannot move sufficiently to retract the curved plates from the inner cylindrical surface of the valve box. Thus, only authorized personnel with the proper padlock key or combination can operate the valve, deterring vandals.

20 Claims, 9 Drawing Sheets

UNDERGROUND SECURITY BARRIER

BACKGROUND OF THE INVENTION

A common issue with excavations and other types of holes, spaces, and enclosures, involves the danger of leaving the space open or uncovered. A person or animal may access the space causing injury, property damage, stop or start utilities, vandalism, or other undesired situations. Authorized individuals, such as utility workers, need access to enclosed spaces. Valve box covers, manhole covers, and other tops, covers, and blocks exist to keep out unauthorized access.

Valve boxes (sometimes referred to as "valve vaults") are commonly used to secure access to buried valves, conduits, or pipe sections. The valve boxes may be covered to protect access to supplies of water, gas, electricity, telecommunication, cable, utilities, and other such flowing or transmission conduits. The valve box is often cylindrical with a lid or cap to protect the valve, prevent animals and people from entering the enclosed area, and to support the weight of vehicles passing over the valve box. Valve boxes often are elongated hollow housings capped at an upper end by a collar or the like, wherein a cap, lid, top, or similar barrier may be removed by a properly authorized person to allow access to the valve, such as by a wrench or other tool. A recurring problem with valve box access is that unauthorized persons may remove the cover, such as to maliciously or accidentally tamper with a valve. Unintended actuation or other operation of a valve disrupts systems, such as utilities. The valve box may be constructed of metal (such as cast iron), concrete, plastic, or other suitable materials. Exemplary valve boxes may be the type of valve boxes available from Bingham & Taylor at 601 Nalle Place, Culpeper, Va. 22701, U.S.A.

Many present devices for securing access to enclosed spaces are cumbersome and contain complicated mechanisms that are costly, difficult to open and secure, and difficult to manufacture.

It would be advantageous to provide an apparatus, method, and system that would include one or more of the features of 1) ease of manufacture; 2) uncomplicated mechanisms; 3) no power supply necessary for operation; 4) simple to allow access to enclosed spaces; and 5) securely preventing unauthorized access to enclosed spaces.

SUMMARY OF THE INVENTION

In one aspect of the present invention, an enclosure covering device may comprise; a top plate, a screw mechanism extending through an aperture in the top plate, the screw mechanism having an upper portion above the top plate and a lower portion below the top plate, a movable arm extending radially from the screw mechanism and operatively coupled to the lower portion of the screw mechanism such that the movable arm may be moved from a retracted position to a deployed position by turning a nut on the screw mechanism, and a locking mechanism preventing access to the screw mechanism, wherein the locking mechanism comprises a padlock engaged with the upper portion of the screw mechanism.

In another aspect of the present invention, an enclosure covering device may comprise; a substantially circular top plate; a screw mechanism comprising an eyelet extending above the substantially circular top plate and an externally threaded portion extending below the substantially circular top plate with a sleeve coupled to the externally threaded portion and extending below the substantially circular top plate; an internally threaded nut matingly engaged with the externally threaded portion of the screw mechanism for turning in a direction substantially perpendicular to the sleeve to urge a sliding collar radially outward; a fixed collar situated below the substantially circular top plate; the sliding collar coupled to the sleeve, opposite of the fixed collar; the sliding collar extending radially from the screw mechanism such that the sliding collar may be moved from a retracted position to a deployed position by turning the internally threaded nut on the screw mechanism; and a locking mechanism preventing access to the screw mechanism.

In yet another aspect of the present invention, a method for covering an enclosure, the method may comprise; placing a lower portion of an enclosure covering device into an enclosure, the enclosure covering device comprising; a top plate with a dimension permitting the top plate to rest near the top of the enclosure; a screw mechanism comprising an eyelet extending above the top plate and an externally threaded portion extending below the top plate with a sleeve coupled to the externally threaded portion and extending below the top plate; an internally threaded nut matingly engaged with the externally threaded portion of the screw mechanism for turning in a direction substantially perpendicular to the sleeve to urge the sleeve radially outward; a stationary arm situated below the top plate; a movable arm coupled to the sleeve, opposite of the stationary arm; a movable arm extending radially from the screw mechanism such that the movable arm may be moved from a retracted position to a deployed position by turning the internally threaded nut on the screw mechanism; and engaging the upper portion of the screw mechanism to more the movable arm from a retracted position to a deployed position, causing the movable arm to engage an interior side of the enclosure when in the deployed position; and locking the screw mechanism to prevent access to the screw mechanism, wherein the step of locking the screw mechanism comprises the step of: locking the top plate to the screw mechanism.

These and other aspects, objects, features and advantages of the present invention, are specifically set forth in, or will become apparent from the following detailed description of an exemplary embodiment of the invention when read in conjunction with the accompanying drawings.

DETAILED DESCRIPTION OF THE INVENTION

Figure 1:
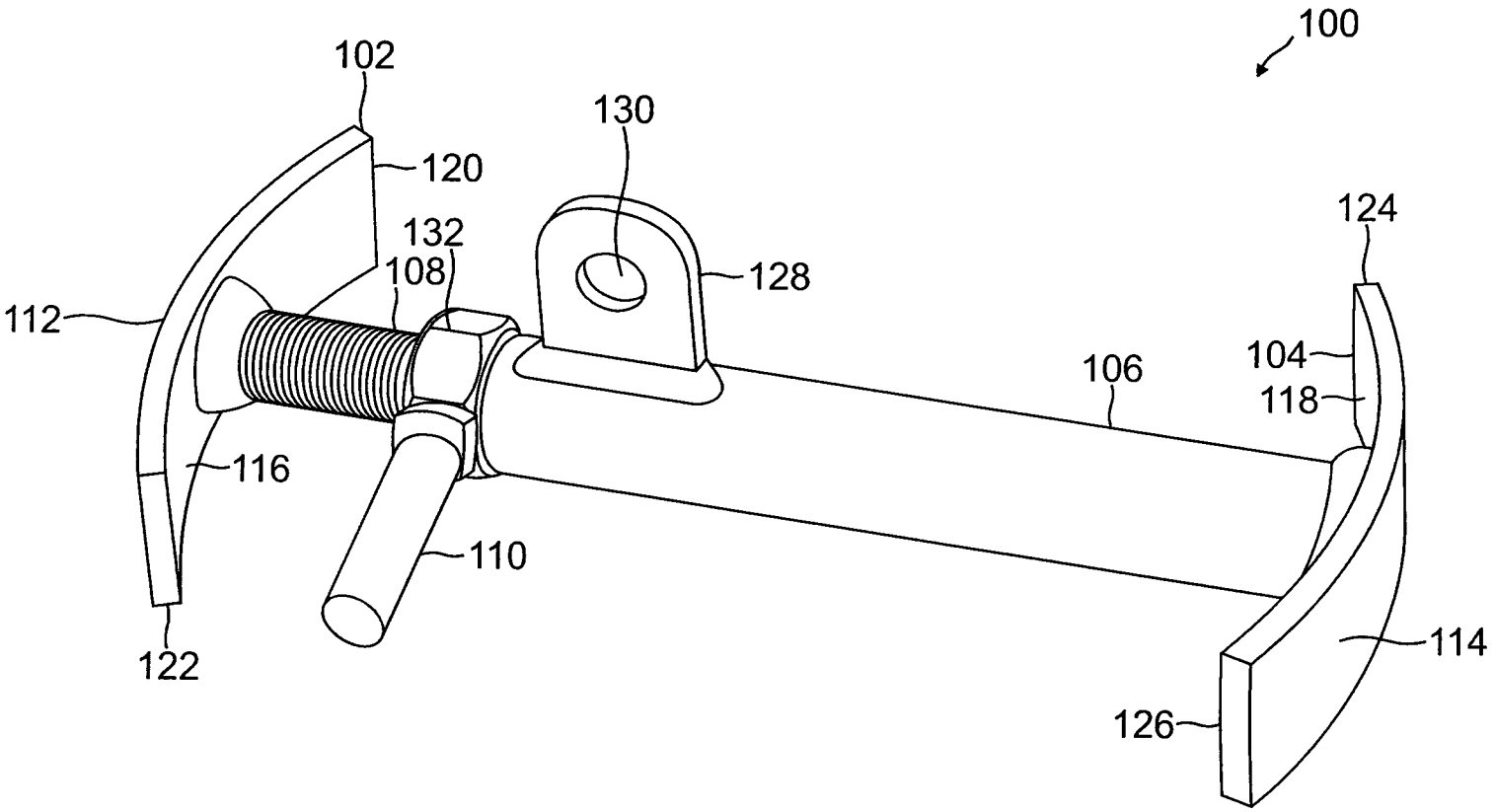
FIG. 1 is a perspective view of a screw mechanism, according to an embodiment of the present invention.

The following detailed description is of the best currently contemplated modes of carrying out the invention. The description is not to be taken in a limiting sense, but is made merely for the purpose of illustrating the general principles of the invention, since the scope of the invention is best defined by the appended claims.

This invention relates generally to an apparatus for securing an underground space or enclosure, such as a manhole, a well, a utility valve box, catch basins, cisterns, or other underground or enclosed spaces or containers.

More specifically, this invention relates to an apparatus for securing an underground space or enclosure such that the apparatus is adjustable to accommodate most configurations of utility valve boxes. While the present invention may be described herein as applying specifically to underground valve boxes, it is to be understood that the invention is suitable for similar applications, such as for manhole access, water supply systems, sewer systems, wells, utility access, and other spaces or enclosures, above ground and underground. It is also to be understood that although the invention may be described as pertaining to the term "valve box," the invention also is suitable for use with an enclosed space called a "valve vault."

Many valves for flowing substances must be situated below ground to reduce the likelihood of freezing, unauthorized access, avoiding hazards for pedestrians, animals, or vehicles, aesthetic reasons, and for other reasons. Such valves are often situated at the bottom of a short shaft with an opening at ground level, such that the opening is closed by a cover.

The present invention provides a mechanism for securing a top lid as a cover for an enclosure regardless of the shape of the lid or enclosure (e.g., circular or rectangular) or size of the shaft or space. The present invention provides for rapid and easy installation into an open space while preventing unauthorized access, such as by vandals or saboteurs. Movable or expandable arms or members may be used to engage with the interior surfaces of a valve box from a retracted position to an extended or engaged position such that the members or arms engage the walls of the valve box. In one embodiment, one arm or member may be movable and the other arm or member may be relatively stationary.

In one embodiment the present invention may comprise a cover assembly for covering an opening of a shaft in the ground, the assembly comprising a cover plate for covering the opening and an expandable anchor assembly adapted to engage the walls of the shaft to anchor the cover plate in position. The expandable anchor assembly may comprise at least one shaft-engaging portion that moves between retracted and extended positions such that a movable shaft-engaging portion may be initially retracted for the anchor assembly to be inserted into the shaft and extended to engage with the shaft. Shaft-engaging shoes may be at distal ends of one or more shaft-engaging portions wherein one or more of the shoes may be movable in opposing directions. Expansion and contraction of the anchor assembly may be accomplished by rotating a nut or other fastener.

The cover of a single shape may cover a smaller opening of any shape and therefore does not need to match the shape of the valve box opening. The mechanism of the present invention is disposed on the underside of the cover and actuable from the outside of the valve box (e.g, from the top side of the cover).

A clear understanding of the key features of the invention summarized above may be attained by referencing the below figures, which illustrate the method and system of the invention, although it will be understood that such drawings depict various exemplary embodiments of the invention and, therefore, are not to be considered as limiting scope with regard to other embodiments which the invention is capable of contemplating.

FIG. 1 shows a screw mechanism 100 according to an exemplary embodiment of the present invention. The screw mechanism may be manufactured from a suitable, durable material, such as cast iron or steel. A first arm 102 may be a stationary arm such that the first arm 102 does not move relative to a second arm 104, which may be a movable arm. A sleeve 106 may be concentric with an externally threaded portion 108 such as an externally threaded bolt. The sleeve 106 may be cylindrical with a cylindrical void for insertion of the externally threaded portion 108.

A handle 110 may be used to rotate a nut 132, such as an internally threaded fastener, such as a hexagonal nut fitting. As the nut 132 is rotated in one direction, the sleeve 106 and the second arm (movable arm) 104 may move in a direction opposite to the first arm (stationary arm) 102 to engage with an interior surface of a valve box by contact with an engagement surface 114 while the first arm 102 may be engaged or pressed against an interior surface of the valve box through contact with an engagement surface 112. If the nut 132 is rotated in another direction, the sleeve 106 and the second arm (movable arm) 104 may move in a direction towards the first arm (stationary arm) 102 to disengage from an interior surface of a valve box by retracting an engagement surface 114 while the first arm 102 may be disengaged from an interior surface of the valve box through stopping or discontinuing contact with an engagement surface 112. Rotation of the nut 132 may urge the arms 102, 104 outwardly towards opposite walls of a valve box or retract inwardly. An inner surface 116 of the first arm may serve to facilitate grasping the screw mechanism. Likewise, an inner surface 118 may facilitate grasping the screw mechanism 100 from the movable arm region. Prongs 120 and 122 may extend distally from the first arm 102 while prongs 124 and 126 may extend distally from the second arm 104.

Optionally, one or more additional arms may be used, such as arms (not shown) perpendicular to the first arm 102 and the second arm 104 to further block access to a valve box. An eyelet 128 may extend substantially orthogonally from an outer surface of the sleeve, with an aperture 130 therein for extending through an aperture of a cover to secure the cover to a valve box, as described below.

Figure 2A:
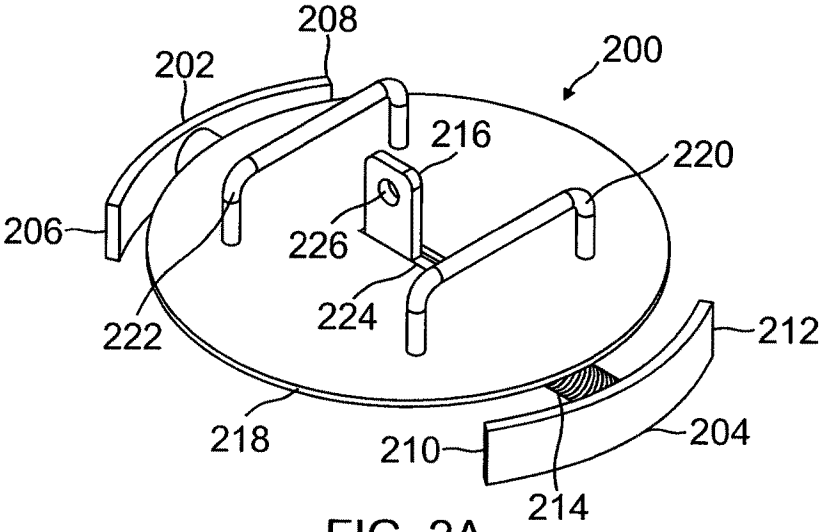
FIG. 2A is an elevational view of a screw mechanism and top lid, according to another embodiment of the present invention.

FIG. 2A shows an elevational view of a screw mechanism 200 and a top lid 218. As can be seen in FIG. 2A, an eyelet 216 protrudes through aperture 224 to provide an eyelet aperture 226 for shackling a lock or chain thereto to secure the top lid 218 to the screw mechanism 200. The first arm 202, with prongs 206, 208, may be stationary relative to the top lid 218 and the second arm 204, which may comprise prongs 210, 212. One or more handles 220, 222 may be used to lift the top lid 218 from the enclosure and to lower the top lid 218 to replace the top lid 218. The externally threaded portion may translate outward radially to move the second arm 204 away from the stationary arm 202 and inward radially to move the second arm 204 towards the first arm 202.

Figure 2B:
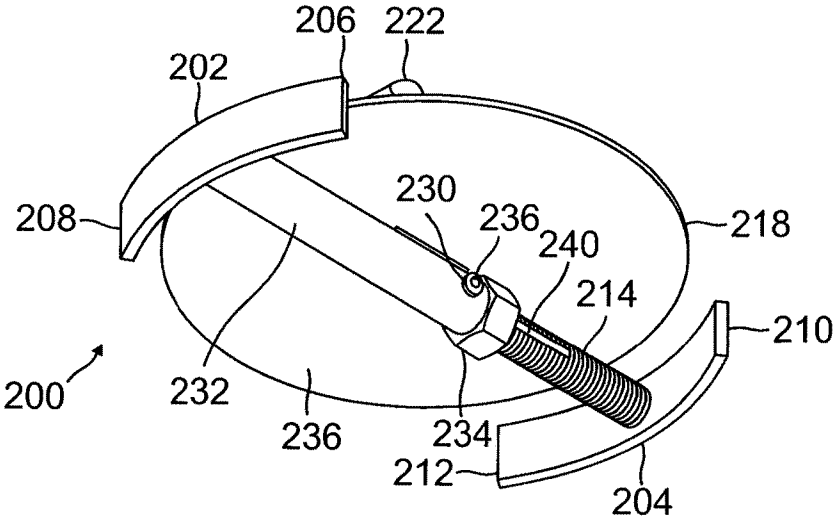
FIG. 2B is a view of an underside of a screw mechanism and a top lid, according to yet another embodiment of the present invention.

FIG. 2B shows a view of an underside of a screw mechanism and a top lid, according to yet another embodiment of the present invention, further demonstrating the structure of the present invention. A recess 230 may serve for receiving a screw, such as a button head 236, for adjusting, calibrating, or otherwise setting the interaction between a hollow sleeve 232, the externally threaded portion 214 with a groove or slot 240, and the nut 234.

Figure 3:
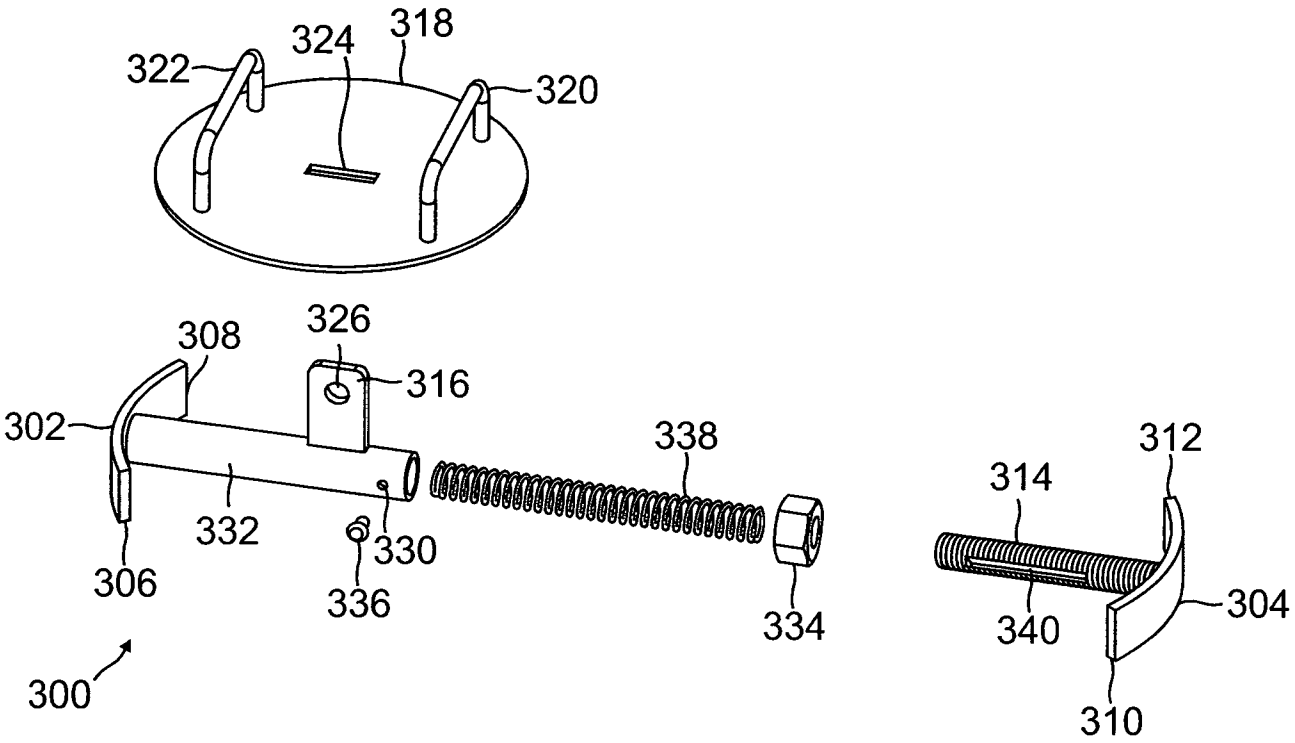
FIG. 3 is an exploded view of a screw mechanism and a top lid, according to still yet another embodiment of the present invention.

FIG. 3 shows an exploded view of the present invention 300 according another embodiment of the present invention. A first arm, also known as a fixed collar 302, may receive a spring 338 within a hollow sleeve 332 for interaction with a second arm, also known as a sliding collar 304, with a nut 334 for securing the sliding collar in place when deployed within a valve box. The spring 338 may provide resilience and force to ensure that the sliding collar sufficiently urges towards an interior wall of a valve box. An eyelet 316 may protrude through lid aperture 324 to provide an eyelet aperture 326 for shackling a lock or chain thereto to secure the top lid 318 to the screw mechanism 300. The fixed collar 302, with prongs 306, 308, may be stationary relative to the top lid 318 and the sliding collar 304, which may comprise prongs 310, 312. One or more handles 320, 322 may be used to lift the top lid 318 from a valve box or other enclosure and to lower the top lid 318 to replace the top lid 318 to a position above the screw mechanism 300. An externally threaded portion of the sliding collar 304 may translate outward radially to move the sliding collar 304 away from the fixed collar 302 and inward radially to move the sliding collar 304 towards the fixed collar 302.

The externally threaded portion 314 may have therein a slot or groove 340, in line with a major axis of the externally threaded portion 314. The groove 340 may maintain proper alignment between the fixed collar 302 and the sliding collar 304. A recess 330 may serve for receiving a screw, such as a button head 336, for locking in position the hollow sleeve 332 with the externally threaded portion 314 of the sliding collar 304. The screw 336 may be turned for adjusting, calibrating, or otherwise setting the interaction between a hollow sleeve 332, the externally threaded portion 314, the groove 340, and the nut 334. When the externally threaded portion 314 is inserted into the hollow sleeve 332, a male portion of the screw 336 may fit into the slot or groove 340 for further securing the sliding collar 304 when deployed within an enclosure, such as a valve box, and for aligning the sliding collar 304 with the fixed collar 302.

Figure 4:
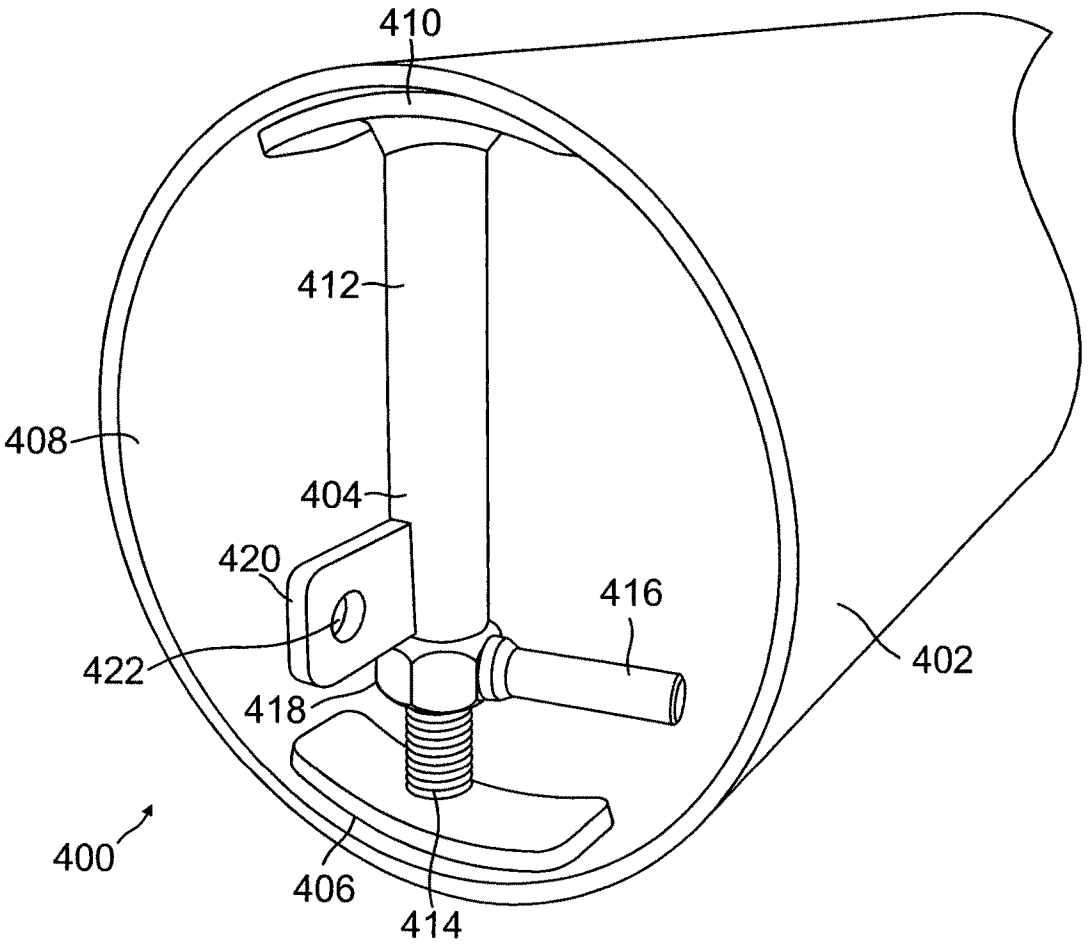
FIG. 4 shows a screw mechanism, with a movable arm deployed within an enclosure, according to a further embodiment of the present invention.

FIG. 4 shows the present invention 400 wherein an enclosure 402 has a screw mechanism 404 deployed within the enclosure 402. A sleeve 412 holds an externally threaded portion 414 to maintain a fixed collar 406 in contact with an inner surface 408 of the enclosure 402. A movable collar 410 may be deployed by being extended to press against the inner surface 408 of the enclosure 402 by rotating the nut 418, with a tool (such as a wrench) or by moving optional handle 416. A sleeve eyelet 420 with an aperture 422 may extend outward from the screw mechanism 404, such as extending perpendicularly from the sleeve 412.

Figure 5:
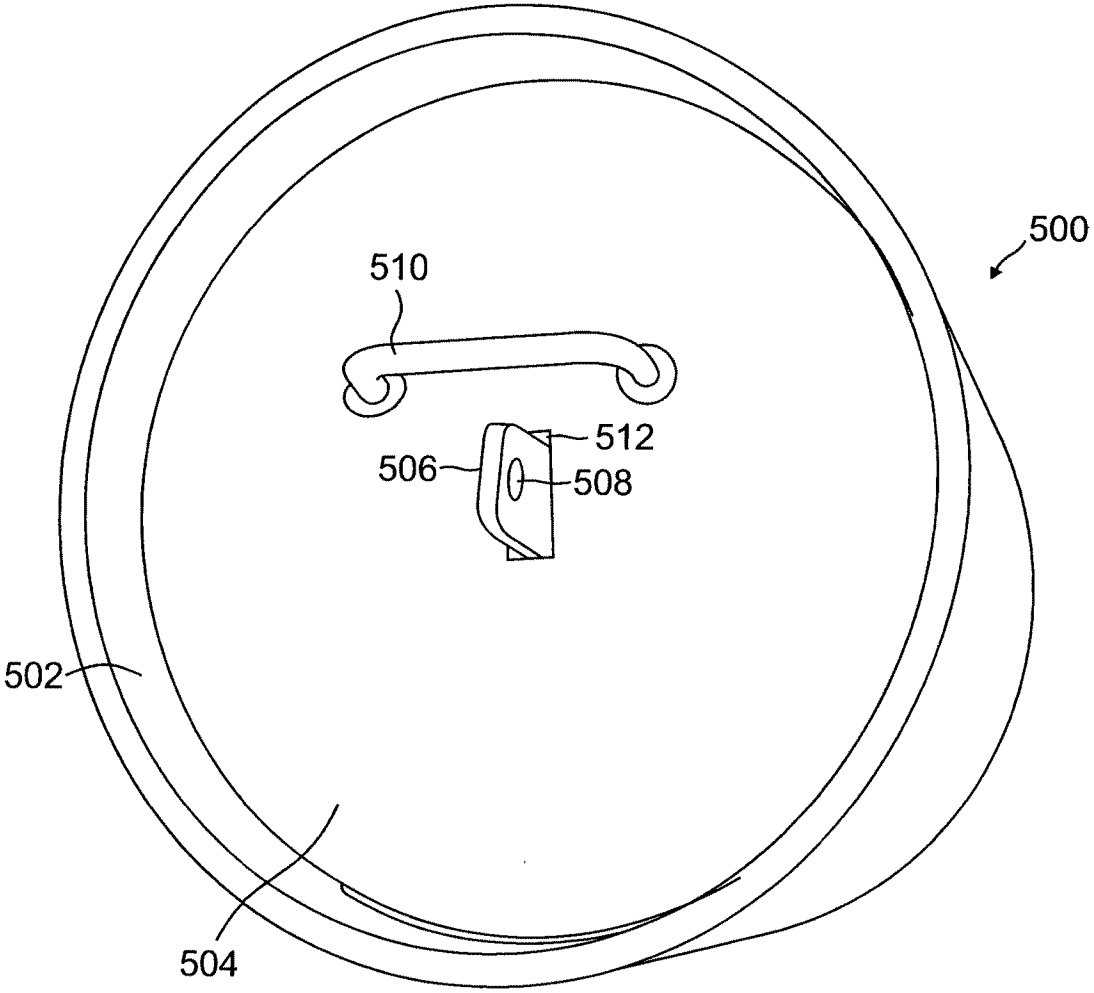
FIG. 5 shows a top lid covering the top of an enclosure while matingly engaging with a screw mechanism including an eyelet protruding from an aperture in the top lid, according to a yet further embodiment of the present invention.

FIG. 5 shows an enclosure 500 with an interior surface 502, wherein a top lid 504 fits inside the interior dimensions 502 to rest on top of the enclosure 500 (e.g., a valve box). A screw mechanism, such as of the type discussed previously in FIGS. 1-4, may be installed within the enclosure 500 and below the top lid 504 with an eyelet 506 protruding through a lid aperture 512 to present an eyelet aperture 508 for inserting a shackle of a padlock, chain, or other security device to prevent removal of the top lid 504. A handle 510 may be used for removing, lifting, lowering, and replacing the top lid 504 to cover the enclosure 500.

Figure 6:
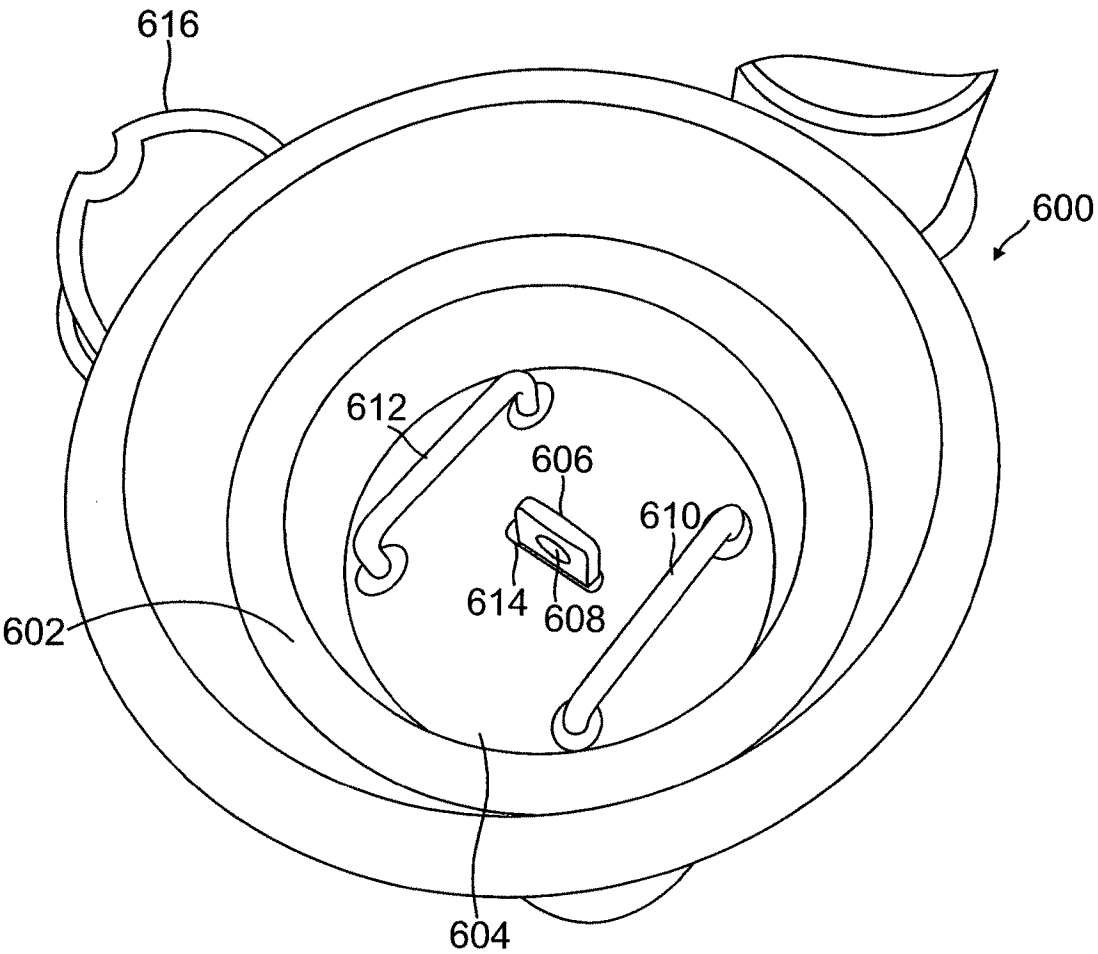
FIG. 6 shows a top lid covering the top of a valve box while matingly engaging with a screw mechanism including an eyelet protruding from an aperture in the top lid, according to a further embodiment of the present invention.

FIG. 6 shows another embodiment, wherein an enclosure 600 (such as a valve box or valve vault) has an interior surface 602. A top lid 604 may fit within the interior surface 602, to rest near the top of the enclosure 600. A screw mechanism, such as of the type discussed previously in FIGS. 1-4, may be installed within the enclosure 600 and below the top lid 604 with an eyelet 606 protruding through a lid aperture 614 to present an eyelet aperture 608 for inserting a shackle of a padlock, chain, or other security device to prevent removal of the top lid 604 from the enclosure 600. One or more handles 610, 612 may be used for removing, lifting, lowering, and replacing the top lid to cover the enclosure 600. A cover 616 may be placed at the opening of the enclosure 600 to protect the enclosure 600 from environmental occurrences, such as rain, wind, snow, debris, and other events, along with providing a surface for vehicles to travel without interruption.

Figure 7:
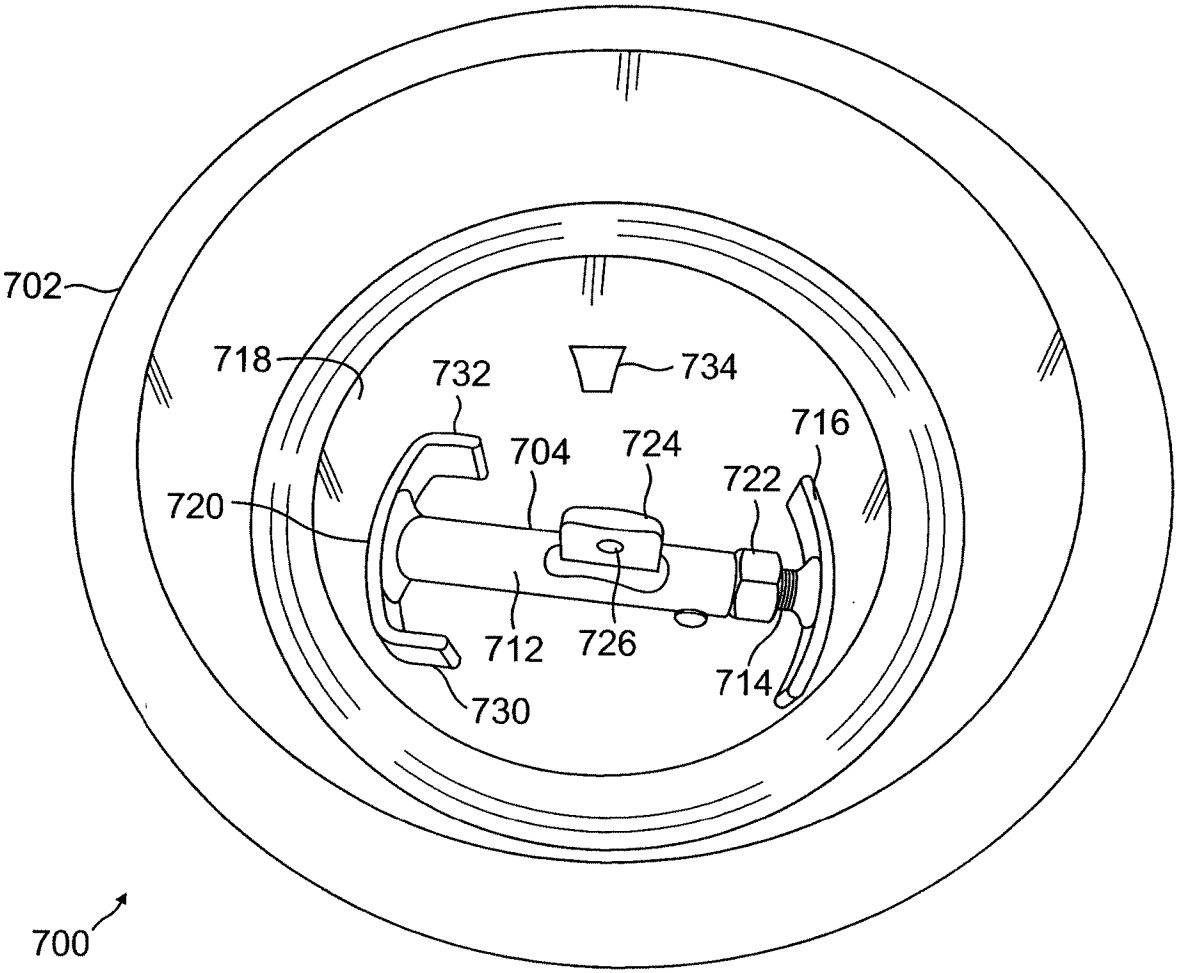
FIG. 7 shows a screw mechanism, with a movable arm deployed within a valve box, without a top lid or valve box cover, according to a still further embodiment of the present invention.

FIG. 7 shows yet another embodiment of the present invention 700 wherein an enclosure 702 has a screw mechanism 704 deployed within the enclosure 702, similar to how the screw mechanism was deployed in FIG. 4 (described above). A sleeve 712 holds an externally threaded portion 714 to maintain a sliding collar 716 in contact with an inner surface 718 of the enclosure 702. A fixed collar 720 may be deployed by being extended to press against the inner surface 718 of the enclosure 702 by rotating the nut 722, with a tool (such as a wrench). Prongs 730, 732 may be essentially parallel with a major axis of the screw mechanism 704 for further support, such as for supporting a top lid such that the top lid may rest upon the prongs 730, 732. The top lid also may rest upon a protrusion 734 that projects inwardly from the inner surface 718 of the enclosure 702. A sleeve eyelet 724 with an aperture 726 may extend outward from the screw mechanism 704, such as extending perpendicularly from the sleeve 712.

Figure 8:
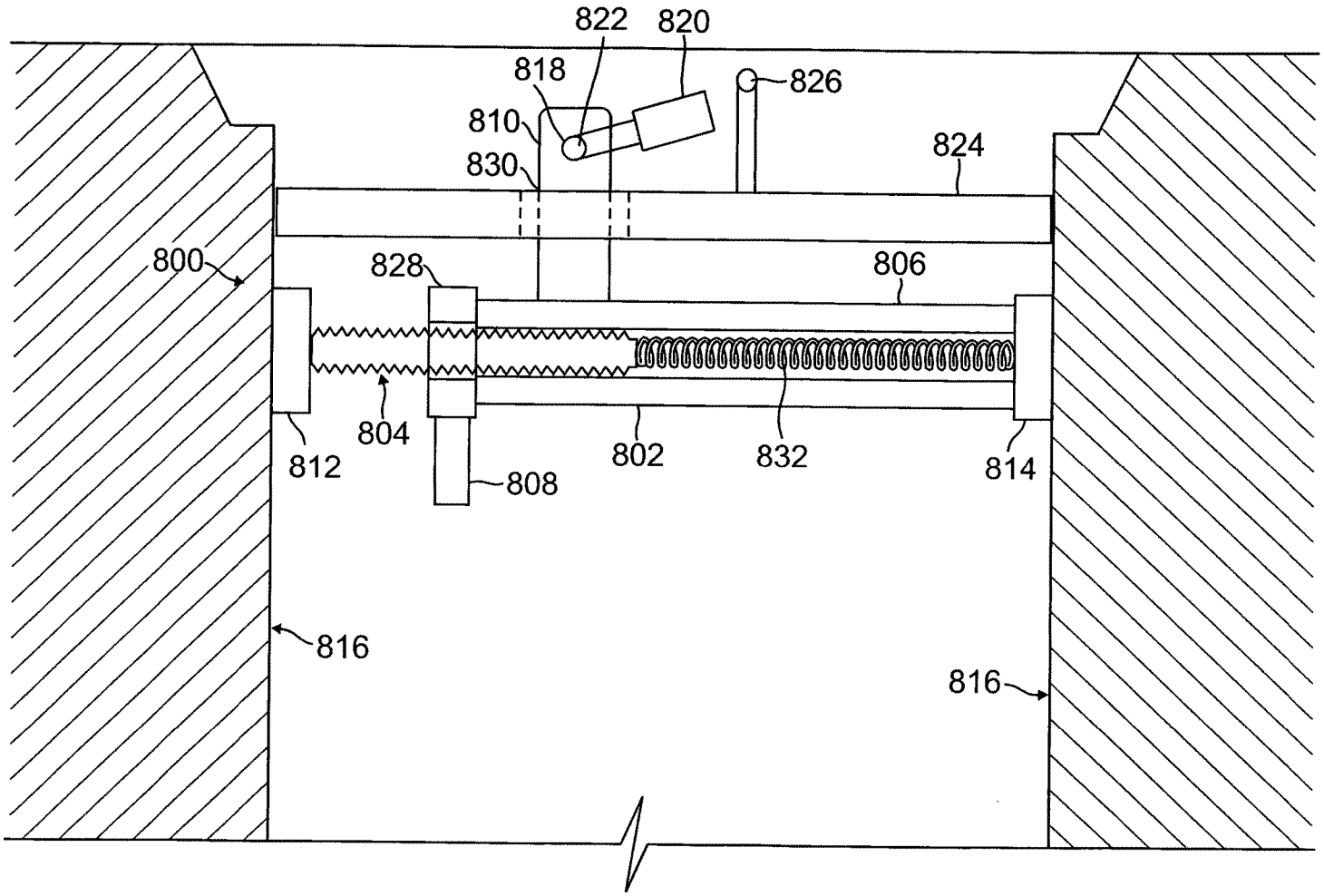
FIG. 8 shows a cross-sectional view of a screw mechanism deployed within an enclosing space, according to yet another embodiment of the present invention.

FIG. 8 shows a cross-sectional view of a screw mechanism 802 deployed within an enclosing space 800, according to yet another embodiment of the present invention. An externally threaded portion 804 may be inserted coaxially within a recess of a sleeve 806, optionally with a spring 830 inserted within a hollow of sleeve 806. The externally threaded portion may be moved towards an inner wall 816 of the enclosure 800 by rotating handle 808 and/or a nut 828 several turns until a movable arm 814 is pressed securely against the inner wall 816 while a stationary arm 812 may maintain contact with the inner wall 816 and sufficient pressure on the inner wall 816 such that the screw mechanism 802 secures a sleeve eyelet 810 that protrudes out of the top lid 824 through a top lid aperture 830. A padlock 820 may be used to lock the top lid 824 in place on top of the enclosure 800 by placing a shackle 822 of the padlock 820 into an eyelet aperture 818 so that the top lid 824 may not be removed without opening the padlock 820 to free up access to the enclosure 800. A handle 826 may be grasped to carry the top lid 824 when opening and closing the enclosure 800.

Figure 9:
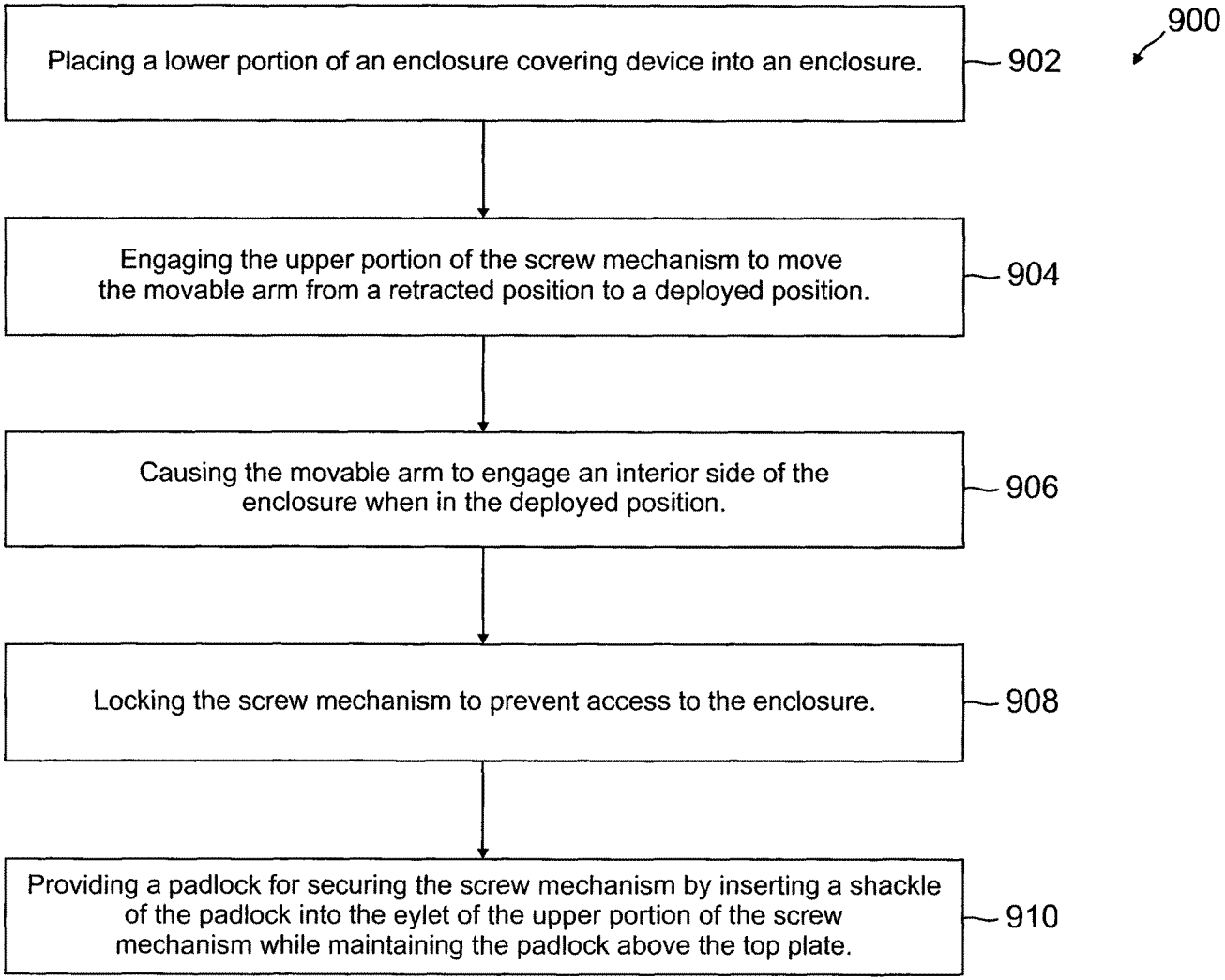
FIG. 9 shows a flowchart depicting an exemplary method, according to a still further embodiment of the present invention.

Turning to FIG. 9 an exemplary method is illustrated in a flow chart. A method 900 for covering an enclosure may comprise; in Step 902, placing a lower portion of an enclosure covering device into an enclosure, the enclosure covering device comprising a top plate with a dimension permitting the top plate to rest near the top of the enclosure, a screw mechanism comprising an eyelet extending above the substantially circular top plate and an externally threaded portion extending below the substantially circular top plate with a sleeve coupled to the externally threaded portion and extending below the substantially circular top, an internally threaded nut matingly engaged with the externally threaded portion of the screw mechanism for turning in a direction substantially perpendicular to the sleeve to urge the sleeve radially outward, a stationary arm situated below the substantially circular top plate, a movable arm coupled to the sleeve, opposite of the stationary arm, a movable arm extending radially from the screw mechanism such that the movable arm may be moved from a retracted position to a deployed position by turning an internally threaded nut on the screw mechanism, and a locking mechanism preventing the screw mechanism from turning a full revolution; a Step 904 of engaging the upper portion of the screw mechanism to move the movable arm from a retracted position to a deployed position, and a Step 906 of causing the movable arm to engage an interior side of the enclosure when in the deployed position. A Step 908 may comprise locking the screw mechanism to prevent turning the screw mechanism a full revolution and/or preventing removal of the top lid, wherein the step of locking the screw mechanism comprises the steps of; a Step 910 of providing a padlock for securing the screw mechanism by inserting a shackle of the padlock into the eyelet of the upper portion of the screw mechanism while maintaining the padlock above the top plate.

It should be understood, of course, that the foregoing relates to exemplary embodiments of the invention and that modifications may be made without departing from the spirit and scope of the invention as set forth in the following claims. Furthermore, a method herein described may be performed in one or more sequences other than the sequence presented expressly herein.

We claim:

1. An enclosure covering device comprising:

a top plate;

a screw mechanism extending through an aperture in the top plate, the screw mechanism having an upper portion above the top plate and a lower portion below the top plate;

a movable arm extending radially from the screw mechanism and operatively coupled to the lower portion of the screw mechanism such that the movable arm may be moved from a retracted position to a deployed position by turning a nut on the screw mechanism; and a locking mechanism preventing access to the screw mechanism, wherein the locking mechanism comprises a padlock engaged with the upper portion of the screw mechanism.

2. The enclosure covering device of claim 1, further comprising:

an aperture within the upper portion of the screw mechanism for securing the padlock to the upper portion of the screw mechanism.

3. The enclosure covering device of claim 1, wherein the screw mechanism comprises a shaft, the shaft disposed substantially parallel with a main plane of the top plate.

4. The enclosure covering device of claim 1, further comprising a stationary arm opposite from the movable arm.

5. The enclosure covering device of claim 1, wherein the top plate is substantially circular.

6. The enclosure covering device of claim 5, wherein the screw mechanism comprises an eyelet extending above the substantially circular top plate and an externally threaded portion extending below the substantially circular top plate with a sleeve coupled to the externally threaded portion and extending below the substantially circular top.

7. The enclosure covering device of claim 6, further comprising a groove within the externally threaded portion for aligning a stationary arm with the movable arm.

8. An enclosure covering device comprising:

a substantially circular top plate;

a screw mechanism comprising an eyelet extending above the substantially circular top plate and an externally threaded portion extending below the substantially circular top plate with a sleeve coupled to the externally threaded portion and extending below the substantially circular top;

an internally threaded nut matingly engaged with the externally threaded portion of the screw mechanism for turning in a direction substantially perpendicular to the sleeve to urge a sliding collar radially outward;

a fixed collar situated below the substantially circular top plate;

the sliding collar coupled to the sleeve, opposite of the fixed collar;

the sliding collar extending radially from the screw mechanism such that the sliding collar may be moved from a retracted position to a deployed position by turning the internally threaded nut on the screw mechanism; and a locking mechanism preventing access to the screw mechanism.

9. The enclosure covering device of claim 8, wherein the locking mechanism comprises a padlock engaged with the eyelet of the screw mechanism.

10. The enclosure covering device of claim 8, wherein the sleeve is disposed substantially parallel with a main plane of the top plate.

11. The enclosure covering device of claim 8, further comprising a second fixed collar.

12. The enclosure covering device of claim 8, further comprising a second sliding collar.

13. The enclosure covering device of claim 8, wherein the externally threaded portion of the screw mechanism is coaxial with the sleeve.

14. The enclosure covering device of claim 8, further comprising a groove within the externally threaded portion of the screw mechanism for aligning the sliding collar with the fixed collar.

15. The enclosure covering device of claim 8, wherein the sliding collar is deployed by translating in a direction opposite of the fixed collar and engages an interior side of an enclosure.

16. The enclosure covering device of claim 8, further comprising a spring situated between the fixed collar and the sliding collar wherein the spring assists the sliding collar to move from a retracted position to a deployed position.

17. A method for covering an enclosure, the method comprising:

placing a lower portion of an enclosure covering device into an enclosure, the enclosure covering device comprising;

a top plate with a dimension permitting the top plate to rest near the top of the enclosure;

a screw mechanism comprising an eyelet extending above the top plate and an externally threaded portion extending below the top plate with a sleeve coupled to the externally threaded portion and extending below the top plate;

an internally threaded nut matingly engaged with the externally threaded portion of the screw mechanism for turning in a direction substantially perpendicular to the sleeve to urge the sleeve radially outward;

a stationary arm situated below the top plate;

a movable arm coupled to the sleeve, opposite of the stationary arm;

a movable arm extending radially from the screw mechanism such that the movable arm may be moved from a retracted position to a deployed position by turning the internally threaded nut on the screw mechanism; and engaging the upper portion of the screw mechanism to more the movable arm from a retracted position to a deployed position, causing the movable arm to engage an interior side of the enclosure when in the deployed position; and locking the screw mechanism to prevent access to the screw mechanism, wherein the step of locking the screw mechanism comprises the step of:

locking the top plate to the screw mechanism.

18. The method for covering an enclosure of claim 17, wherein the locking the top plate to the screw mechanism step comprises:

providing a padlock for securing the screw mechanism by inserting a shackle of the padlock into the eyelet of the upper portion of the screw mechanism while maintaining the padlock above the top plate.

19. The method for covering an enclosure of claim 17, wherein the top plate is substantially circular.

20. The method for covering an enclosure of claim 17, wherein the top plate is substantially rectangular.

* * * * *